US006773288B2

(12) United States Patent
Geltsch et al.

(10) Patent No.: US 6,773,288 B2
(45) Date of Patent: Aug. 10, 2004

(54) CONNECTION SYSTEM FOR FLEXIBLE FLAT STRIP CABLES

(75) Inventors: Hans-Otto Geltsch, Berg-Sindlbach (DE); Michael Hopf, Numberg (DE); Robert Janitschke, Numberg (DE)

(73) Assignee: FCI, Paris (FR)

( * ) Notice: Subject to any disclaimer, the term of this patent is extended or adjusted under 35 U.S.C. 154(b) by 81 days.

(21) Appl. No.: 10/116,300

(22) Filed: Apr. 4, 2002

(65) Prior Publication Data

US 2002/0177346 A1 Nov. 28, 2002

(30) Foreign Application Priority Data

Apr. 4, 2001 (DE) ..... 101 16 454

(51) Int. Cl.[7] ..... H01R 13/62

(52) U.S. Cl. ..... 439/329; 439/495; 439/67; 439/325; 439/354

(58) Field of Search ..... 439/329, 67, 77, 439/492–499, 325–328, 354

(56) References Cited

U.S. PATENT DOCUMENTS

| | | | | | |
|---|---|---|---|---|---|
| 3,533,049 | A | * | 10/1970 | Thompson | 439/391 |
| 3,897,130 | A | | 7/1975 | Donnelly et al. | 339/176 MF |
| 4,640,562 | A | * | 2/1987 | Shoemaker | 439/77 |
| 4,691,972 | A | * | 9/1987 | Gordon | 439/77 |
| 4,740,867 | A | * | 4/1988 | Roberts et al. | 361/749 |
| 4,969,840 | A | * | 11/1990 | Ii et al. | 439/495 |
| 5,295,838 | A | | 3/1994 | Walen et al. | 439/67 |
| 5,401,186 | A | * | 3/1995 | Nozaki et al. | 439/495 |
| 6,364,695 | B1 | * | 4/2002 | Watanabe | 439/498 |

FOREIGN PATENT DOCUMENTS

| | | |
|---|---|---|
| DE | 1 920 988 | 5/1970 |
| DE | 1665171 | 10/1970 |
| DE | 3624714 A1 | 1/1987 |
| DE | 19832012 A1 | 2/2000 |
| EP | 0 269 248 A1 | 1/1988 |
| EP | 0431260 A1 | 6/1991 |
| EP | 0 431 260 A1 | 12/1991 |
| FR | 1174063 | 11/1958 |
| GB | 2 178 252 A | 4/1987 |

* cited by examiner

*Primary Examiner*—Truc Nguyen
(74) *Attorney, Agent, or Firm*—Perman & Green, LLP

(57) ABSTRACT

The present invention relates to a connection system for flexible flat strip cables (1*a*,1*b*) comprising conductors arranged parallel to one another, which are stripped of insulation in the area of the connection which is to be made and which are provided with means of positive fixing of the flexible flat strip cables to be connected in a connection housing (2), which has two housing parts (2*a*,2*b*) able to be joined together and a slide (3) for the pressing together in the areas which have been stripped of insulation, of the flexible flat strip cables (1*a*,1*b*), which are to be connected.

14 Claims, 5 Drawing Sheets

CONNECTION SYSTEM FOR FLEXIBLE FLAT STRIP CABLES

BACKGROUND OF THE INVENTION

Field of the Invention

The present invention relates to a connection system for flexible flat strip cables comprising parallel strip conductors arranged at a distance from one another. These are stripped of insulation in the area of the connection which is to be made and are pressed to one another in that area.

Such flat strip cables are used in vehicles for, for example, loop circuits of multiplex systems for the distribution of current and control signals. Branch conductors lead from these loop circuits to consuming points, sensors or the like. According to the individual equipment of a motor vehicle, different cabling layouts are required. There is therefore a great need for connection systems with which it is possible to connect branch conductors, simply and rapidly, to principal flat strip cable loop circuits.

BRIEF SUMMARY OF THE INVENTION

It is accordingly the purpose of the present invention to provide a connection system for flexible flat strip cables, which can be used to connect several flat strip cables simply and rapidly to one another at any desired points.

This purpose is reached according to one of the claims with the characteristics of preferred embodiments of the present invention appearing in the subsidiary claims. The present invention is based on the idea of selectively stripping the insulation from flexible flat strip cables in any places from which branch conductors or the like are to be led, to press the conductor areas stripped of insulation to one another and to provide housings able to be joined together in the simplest possible manner and with which the flexible flat strip cables to be connected can be exactly positioned with respect to one another and subsequently pressed to one another.

BRIEF DESCRIPTION OF THE DRAWINGS

The invention is explained in greater detail by means of the description of preferred embodiment examples and by reference to drawings.

DETAILED DESCRIPTION OF THE INVENTION

Figure 1:
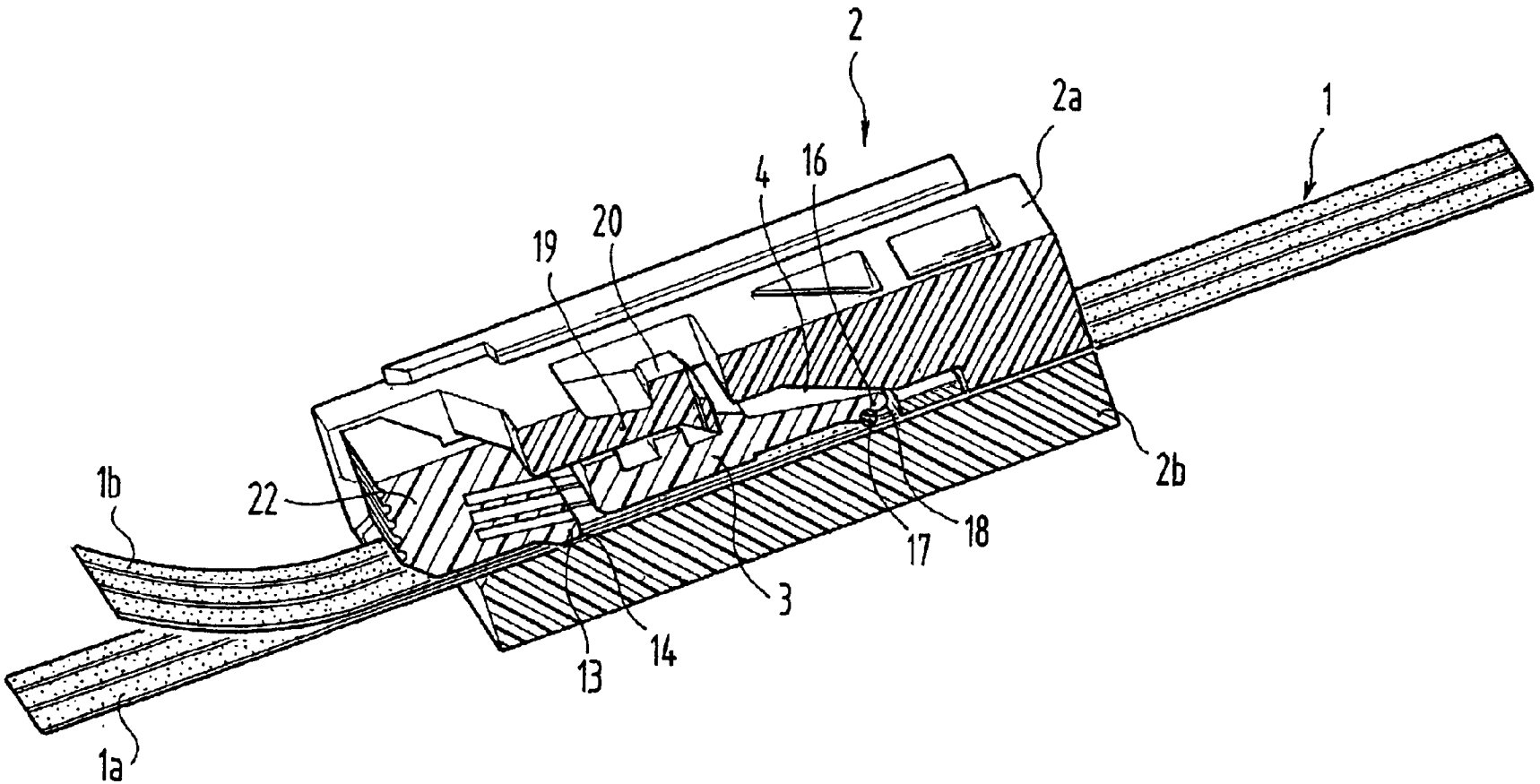
FIG. 1 shows in perspective a longitudinal section of the first embodiment of the present invention.

FIG. 1 shows a longitudinal section of a first embodiment along the central axis of the flat strip cable 1. This consists of conductors arranged parallel to one another, which are connected to a flexible plastic support and insulated thereby. The connection housing 2 consists of an upper housing part 2*a*, a lower housing part 2*b* and a slide 3. As is shown in FIG. 1, the slide 3 can be slid between a front lock-in position and an end lock-in position, in which the areas of the flexible flat strip cable 1*a*,1*b*, which have been stripped of insulation are to be pressed to one another. The upper housing part 2*a* has a ramp 4, along which the wedge-shaped slide 3, when being slid into its end lock-in position, is pressed increasingly firmly against the flexible flat strip cables lying opposite one another. The locking arm 19 has, in the upper housing part 2*a*, for locking the wedge slide 3 into the front- or back lock-in position, a bracket 20, into which a loosening tool or a fingernail can be inserted in order to take off the lock and release the slide 3. The slide 3 also has a catch stop 13, elastically suspended from the spring arms, which snaps into the corresponding recesses 14 of the branch cable 1*b* which is to be connected with the principal cable 1*a*, whereby the branch cable 1*b* is, during the travel of the slide 3, pulled into its end lock-in position and an exactly defined positioning takes place of the areas of the principal cable 1*a* and the branch cable 1*b* which have been stripped of insulation. A pressure rib 18 is formed on the front face of the slide 3, whereby the pressure is locally distributed over a small section surface. This pressure rib 18 may have introduced into it an insert of silicone or rubber or the like 17, in order to increase adhesion there between the slide and the branch conductor and in order to achieve an even force distribution over the entire flexible conductor under a permanent load.

Figure 2B:
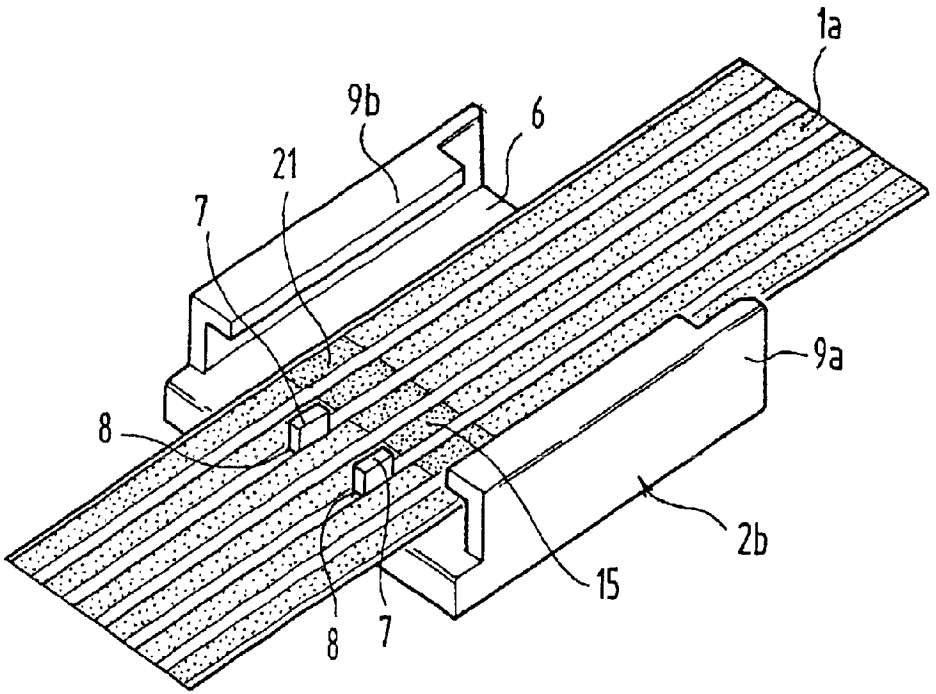
FIGS. 2*a* to 2*e* show the preparation of a connection of two flat strip cables, using the connection system according to FIG. 1
Figure 2A:
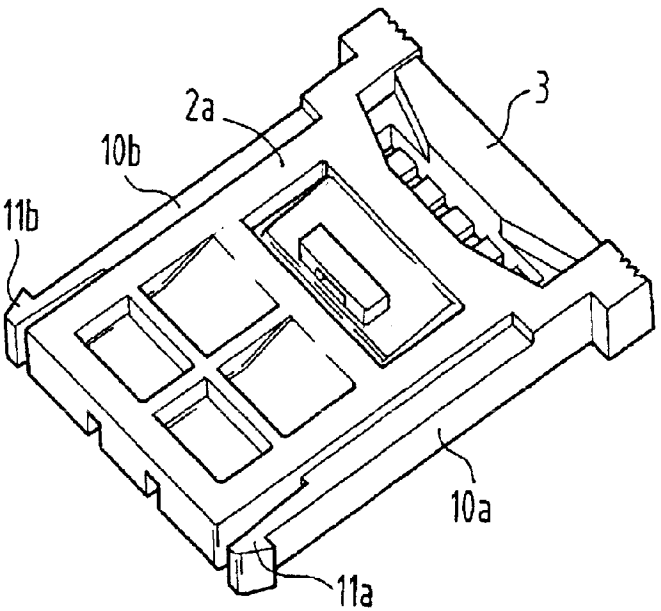

FIGS. 2*a* to 2*e* show the process of assembly of the first embodiment example of the connection system according to FIG. 1. FIG. 2*a* shows the upper part 2*a* of the housing 2 with the pre-assembled slide 3 in the front lock-in position. The upper housing part 2*a* has, arranged on flexible arms on its sides, outward-pointing snap-in latches 11*a* and 11*b*.

FIG. 2*b* shows the lower housing part 2*b* with a floor area 6 for receiving the flexible flat strip cable 1*a*. This has recesses 8 into which snap the locking stops 7 which are provided in the floor area 6, whereby a precise positioning of the flat strip cable 1*a* on the floor area 6 of the lower housing part 2*b* of the housing 2 takes place. FIG. 2*b* moreover shows the areas 21 which have been stripped of insulation, opposite which should lie the correspondingly stripped areas of the branch flat strip cable 1*b*.

Figure 2E:
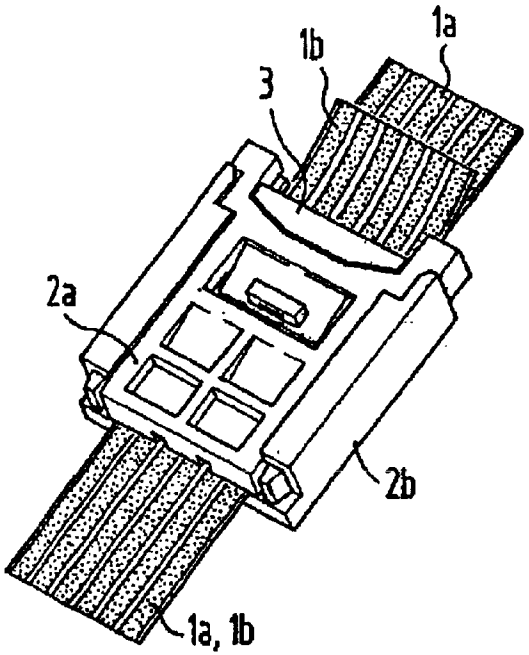
Figure 2D:
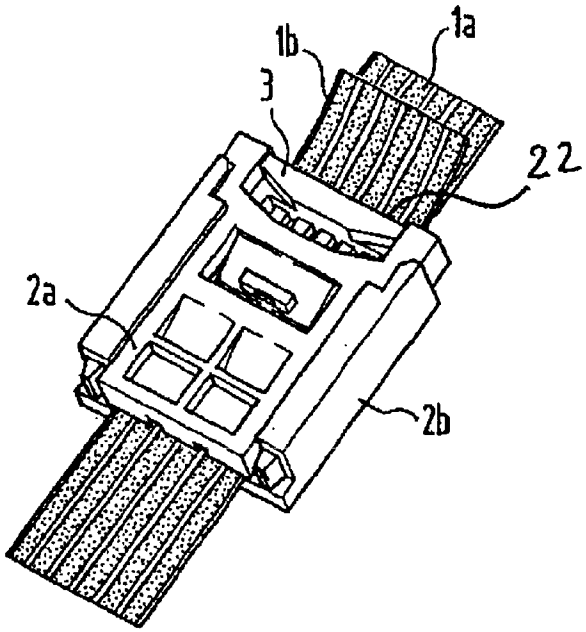
Figure 2C:
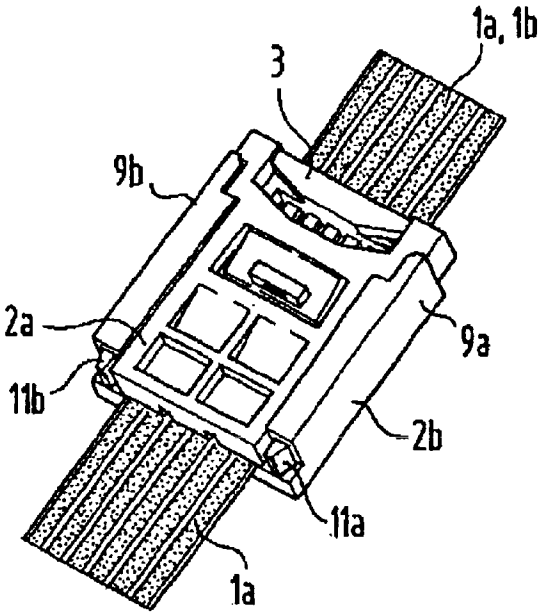

FIG. 2*c* shows the next step of the assembly, in which both the housing parts 2*a* and 2*b* are joined to the pre-assembled slide 3, where the two housing parts snap to the end of the guide grooves 9*a* or 9*b* by means of the snap-in latches 11*a*, 11*b*.

FIG. 2*d* shows as the next step the insertion of the branch flat strip cable 1*b* into the assembled housing from the side on which the actuating surface 22 of the wedge-shaped slide 3 protrudes from the housing in the front lock-in position. The branch flat strip cable 1*b* is inserted into the housing 2, until the recesses 14 which are provided on the flat strip cable 1*b*, reach the level of the snap-in catch stops 13 which snap into the said recesses and lock the branch flat strip cable 1*b* opposite the slide 3.

Lastly, FIG. 2*e* shows the wedge-shaped slide 3 in the end lock-in position in which the connection between the two flat strip cables 1*a*,1*b* is made. During the travel of the slide 3 into the end lock-in position, the slide pulls the branch conductor by means of locking of the catch stop 13 into the recess 14, where, by means of the wedge 4, the pressure with which the flat strip cables 1*a*,1*b* are pressed to one another gradually rises. Through the friction between any areas of the two flat strip cables 1*a*,1*b*, from which insulation has been stripped, the said contact areas are simultaneously cleaned, thereby improving electrical contact.

Figure 3:
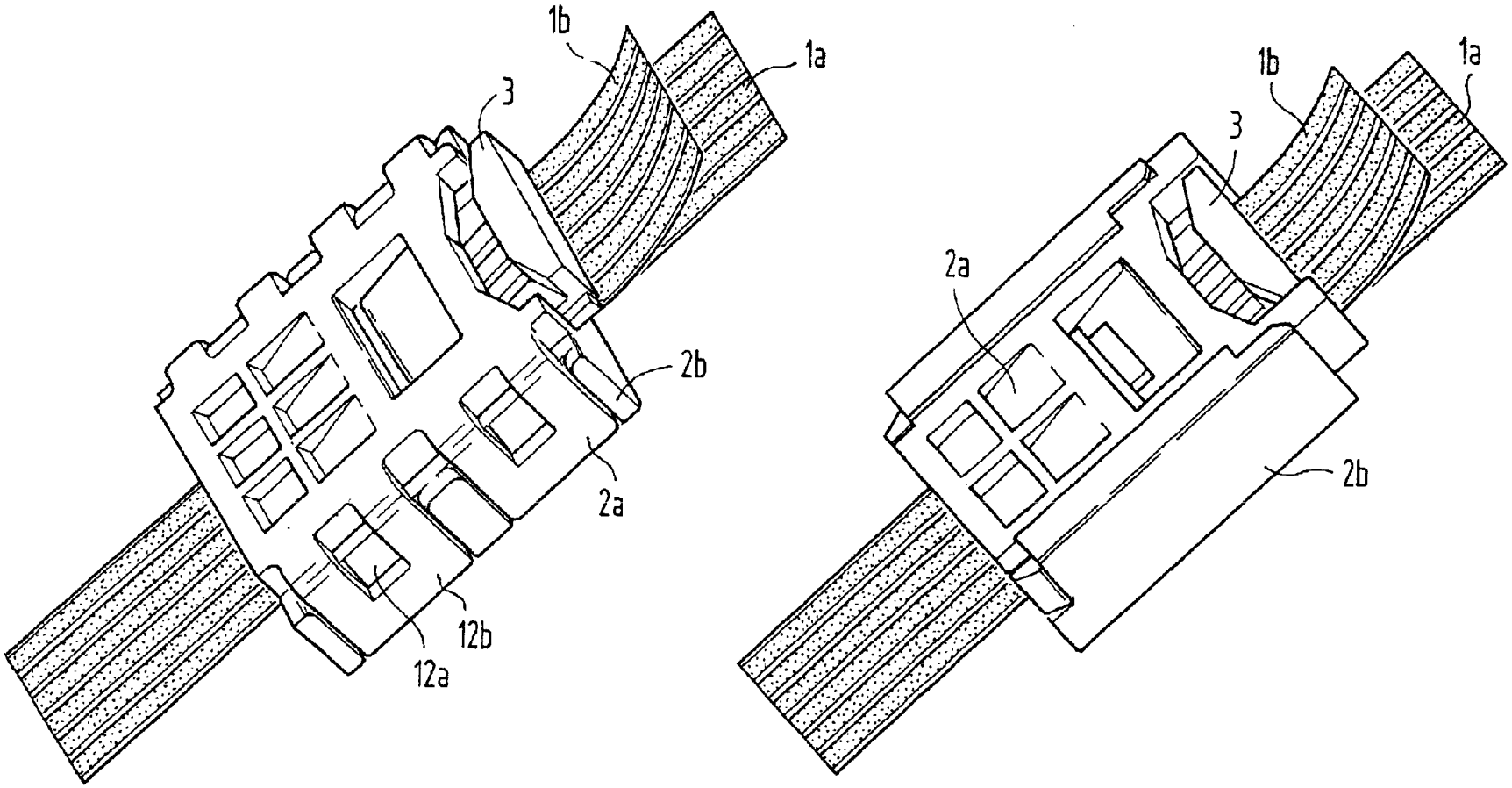
FIG. 3 shows two versions of the connection of the housing parts.

FIG. 3 shows two construction-related possibilities of fastening the two housing parts 2*a*, 2*b* to one another. On the left is shown interconnection by means of insertion vertically to the cable axis. The housing parts 2*a*,2*b* are locked together by means of locking elements 12*a*,12*b*. The version illustrated on the right side of FIG. 3 corresponds, on the other hand, to the embodiment example shown in FIG. 1, where the housing parts 2*a*,2*b* are inserted into one another in the direction of the cable axis and then locked, as has already been explained earlier in greater detail.

Figure 4:
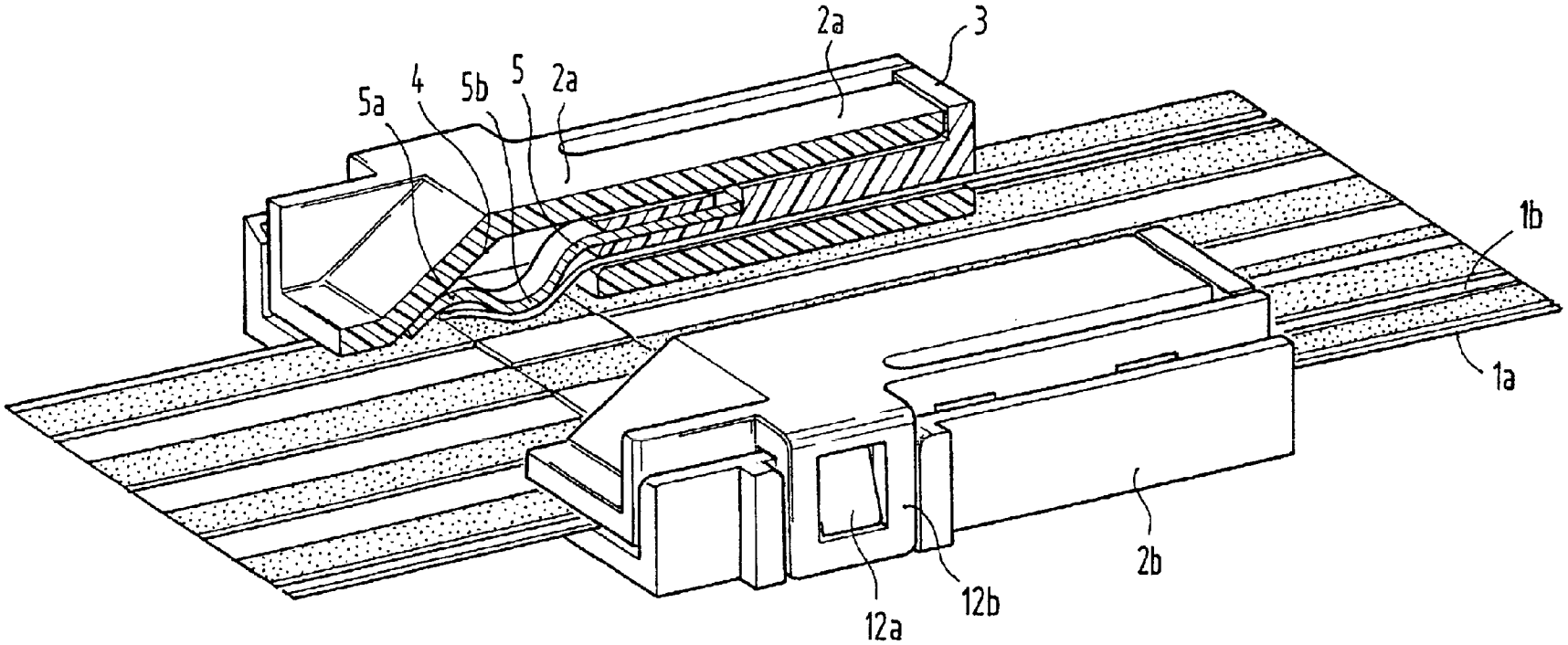
FIG. 4 shows a second embodiment of a connection system according to the invention.

FIG. 4 shows a second embodiment of a connection system according to the invention, where the slide 3 has a flexible tongue 5 on its front face. The said flexible tongue is substantively bent into the shape of an S, where the convexity 5*a* on the front face slides along the ramp with its back in the course of the travel of the wedge-shaped slide 3 into the end lock-in position. This presses the flexible tongue 5 downwards, so that the second convexity 5*b* in the areas of the two flat strip cables 1*a*,1*b* from which insulation has been stripped and which are to be connected with one another, is pressed against them.

The fastening together of the housing parts 2*a*,2*b* also takes place via the locking elements 12*a*, 12*b* and via the insertion of the housing parts 2*a*, 2*b* into one another vertically to the flat strip cable axis.

The preceding description of two embodiment examples of the present invention has the object of illustration only and is not be to regarded as being in any way limiting.

What is claimed is:

1. A connection system for interconnecting flexible flat strip cables comprising conductors arranged parallel to one another, from which insulation has been stripped in the area of the connection which is to be made and which have available a means for the positive fixing of the flexible flat strip cables to be connected in a connection housing, which has two housing parts able to be joined together and a slide for pressing together the flexible flat strip cables to be connected in the areas which have been stripped of insulation.

2. A connection system according to claim 1, characterised by the fact that the slide is a wedge-shaped slide which is able to travel between a front lock-in position and a locking position in a direction of the cable axis.

3. A connection system according to claim 1, characterised by the fact that the slide is a flexible slide, on whose front face is arranged a ramp in a housing part, on which a flexible tongue, which is able to be pressed on the flat strip cables which are to be connected is arranged, the slide being able to travel in the direction of the cable axis between a front lock-in position and a locking position.

4. A connection system according to claim 1, characterised by the fact that a lower housing part has a floor area to receive a principal flexible strip cable, with at least one locking stop to snap into at least one corresponding recess in the cable.

5. A connection system according to claim 4, characterised by the fact that the lower housing part has axially placed side walls, with sliding grooves for introducing and locking of an upper housing part, arranged axially to both sides of the floor area.

6. A connection system according to claim 5, characterised by the fact that the upper housing part has, on flanks which snap into the sliding grooves of the lower housing part, outward pointing snap-in latches on locking arms running axially.

7. Connection systems according to claim 4, characterised by the fact that the upper housing part and the lower housing part can be connected transversely to a direction of the axis by means of being inserted on one another by means of locks.

8. A connection system for flexible flat strip cables comprising conductors arranged parallel to one another, from which insulation has been stripped in the area of the connection which is to be made and which have available a means for the positive fixing of the flexible flat strip cables to be connected in a connection housing, which has two housing parts able to be joined together and a slide for pressing together the flexible flat strip cables to be connected in the areas which have been stripped of insulation, wherein the slide is a wedge-shaped slide which is able to travel between a front lock-in position and a locking position in a direction of the cable axis, and characterised by the fact that the wedge-shaped slide has catch stops arranged on flexible arms for elastic snapping into recesses, with which a branch conductor is, during the travel of the wedge-shaped slide, pulled into the locking position, until the contact areas of the flexible flat strip cable which is to be connected and from which insulation has been stripped, lie on top of one another.

9. A connection system according to claim 8, characterised by the fact that the front face of the wedge-shaped slide is pressed with gradually increasing pressure into the locking position on the flexible flat strip cable by means of a ramp arranged in the upper housing part, whereby the contact areas from which insulation has been stripped, clean one another by friction against one another.

10. A connection system for flexible flat strip cables comprising conductors arranged parallel to one another, from which insulation has been stripped in the area of the connection which is to be made and which have available a means for the positive fixing of the flexible flat strip cables to be connected in a connection housing, which has two housing parts able to be joined together and a slide for pressing together the flexible flat strip cables to be connected in the areas which have been stripped of insulation, wherein the slide is a flexible slide, on whose front face is arranged a ramp in a housing part, on which the flexible tongue, which is able to be pressed on the flat strip cables which are to be connected is arranged, the slide being able to travel in the direction of the cable axis between a front lock-in position and a locking position, and characterised by the fact that the elastic tongue is bent into a shape of an S, so that the first convexity on a front face slides along a ramp of the upper housing part and the second convexity is pressed against the flexible flat strip cable.

11. A connection system according to claim 2, characterised by the fact that the wedge-shaped slide has on its front face a rounded pressure rib which runs transversely to the flexible flat strip cables.

12. A connection system according to claim 11, characterised by the fact that the pressure rib has, in the area of contact with the flexible flat strip cable, an insert of silicone or rubber.

13. A connection system for flexible flat strip cables comprising conductors arranged parallel to one another, from which insulation has been stripped in the area of the connection which is to be made and which have available a means for the positive fixing of the flexible flat strip cables to be connected in a connection housing, which has two housing parts able to be joined together and a slide for pressing together the flexible flat strip cables to be connected in the areas which have been stripped of insulation, wherein the slide is a wedge-shaped slide which is able to travel between a front lock-in position and a locking position in a direction of the cable axis, and characterised by the fact that a locking arm on the upper housing part for locking the slide, has a bracket for the insertion of a loosening tool.

14. A connection system according to claim 1, characterised by the fact that the lower housing part comprises an insert of silicone or rubber, which acts as a support to confer long-term stability in the area of contact to provide contact strength.

* * * * *